US005192099A

United States Patent [19]

Riutta

[11] Patent Number: 5,192,099

[45] Date of Patent: Mar. 9, 1993

[54] ROLLER SKATE STARTING AND STOPPING AIDS

[76] Inventor: Raine R. Riutta, 7816 Jasper Crescent, Vancouver, British Columbia, Canada, V5P 3S9

[21] Appl. No.: 751,162

[22] Filed: Aug. 27, 1991

[51] Int. Cl.[5] ..... A63C 17/14

[52] U.S. Cl. ..... 280/11.2; 188/29; 188/74; 188/196 M; 280/11.22

[58] Field of Search ..... 280/11.2, 11.21, 11.22; 188/29, 74, 177, 195, 196 M

[56] References Cited

U.S. PATENT DOCUMENTS

| | | | |
|---|---|---|---|
| 2,942,698 | 6/1960 | Bolinger | 188/29 X |
| 3,493,085 | 2/1970 | Libhart | 188/196 M |
| 4,037,852 | 7/1977 | Bayer et al. | 188/29 X |
| 4,061,348 | 12/1977 | Carter | 280/11.21 |
| 4,911,456 | 3/1990 | Sarazen | 280/11.2 |
| 5,088,748 | 2/1992 | Koselka et al. | 280/11.2 |

FOREIGN PATENT DOCUMENTS

| | | | |
|---|---|---|---|
| 2800695 | 8/1978 | Fed. Rep. of Germany | 280/11.2 |
| 2160780 | 1/1986 | United Kingdom | 280/11.2 |

OTHER PUBLICATIONS

WO 82/01828 Jun. 1982.

*Primary Examiner*—David M. Mitchell
*Assistant Examiner*—Michael Mar
*Attorney, Agent, or Firm*—Barrigar & Oyen

[57] ABSTRACT

A roller skate brake in which the wheel support which rotatably couples the skate's wheels to the boot is slotted, allowing the support to flex when the skater bears down with the heel. Such flexing compresses the support, forcing a brake shoe against the skate's rear wheel. The braking force varies in proportion to the applied force, and is released when the skater stops bearing down. A roller skate starter aids initial propulsion of a roller skate's wheels. The starter incorporates a restraining mechanism which prevents reverse rotation of the skate's toe wheel, while allowing forward rotation thereof.

4 Claims, 8 Drawing Sheets

ROLLER SKATE STARTING AND STOPPING AIDS

FIELD OF THE INVENTION

This application pertains to a roller skate brake for braking a roller skate wheel; and, to a roller skate starter for aiding a roller skater's initial propulsion of a roller skate wheel.

BACKGROUND OF THE INVENTION

Roller skates having a plurality of longitudinally aligned wheels are currently popular. Such roller skates typically consist of a boot fixed to a pair of wheel support members between which the wheels are rotatably supported.

It can be difficult for a roller skater to come to a quick, controlled stop. Conventional roller skates are equipped with a brake pad fixed to the end of an arm which protrudes downwardly from the heel portion of at least one of the roller skate boots. The roller skater tips the foot wearing the brake-equipped skate backwards in order to force the brake pad against the ground, thereby fictionally braking the roller skater's motion. Brakes of this sort do not afford a high degree of control over the braking action, particularly if the skater encounters uneven terrain. Moreover, by tipping the braking foot backwards as aforesaid, the skater may lose balance at precisely the moment when it is required if the skater is to avoid injury (i.e. if the skater must brake to avoid falling, hitting an object, etc.).

It can also be difficult for an inexperienced skater to start the initial propulsion of the roller skate wheels required to begin roller skating. Experienced roller skaters develop a technique in which one foot is placed to the rear and at an angle. The skater drives forwardly off that foot. The wheels of the roller skate worn on that foot are prevented from rotating in this situation because they are positioned at a substantial angle to the desired direction of forward motion. It can be difficult for inexperienced skaters to develop this technique. Accordingly, inexperienced skaters may have difficulty in quickly attaining a reasonable skating speed. It becomes easier for skaters to maintain balance and control once a reasonable skating speed has been attained. Skaters who cannot quickly attain a reasonable skating speed are prone to loss of balance, falling, etc.

The present invention accordingly provides roller skate starting and stopping aids which overcome the disadvantages of the prior art.

SUMMARY OF THE INVENTION

In accordance with the preferred embodiment, the invention provides a roller skate brake for braking a roller skate wheel. Such wheels are conventionally rotatably supported by a wheel support means mated to a boot. The brake incorporates a flex means for accommodating compression of the wheel support means adjacent the wheel upon application of a force, by the boot, to the flex means. The flex means relieves such compression when the force is removed. A brake means is coupled between the wheel support means and the wheel for applying a braking force to the wheel upon compression of the flex means; and, for releasing the braking force upon the relief of such compression. Preferably, the flex means accommodates variable compression of the wheel support means, the compression varying in proportion to the applied force, thereby varying the braking force in proportion to the applied force.

The flex means may take the form of a first slot formed in the wheel support means between the boot and the rotatable wheel support. The brake means may comprise a brake pad coupled between the wheel support means above the wheel.

An adjusting means may be provided for adjustably positioning the brake pad relative to the wheel. The adjusting means may comprise a second slot formed in the wheel support means between the boot and the first slot; a coupling means on the brake pad for slidably coupling the brake pad within the second slot; and, a fastening means for fastening the coupling means at a selected position relative to the second slot. Alternatively, the adjusting means may comprise a coupling means for pivotally coupling the brake pad to the wheel support means; a first gear means on the brake pad; a second gear means meshed with the first gear means and rotatably supported by the wheel support means; and, a fastening means for fastening the second gear means at a selected position relative to the first gear means.

The invention also provides a roller skate starter for aiding initial propulsion, by a roller skater, of a roller skate wheel rotatably supported by wheel support means mated to a boot. The starter incorporates a restraining means which prevents reverse rotation of the wheel, while allowing forward rotation thereof. Advantageously, the restraining means comprises a restraining member having one end pivotally coupled to the wheel support means and having a second end for bearing against the wheel. A friction means is provided on the second end for preventing reverse rotation of the wheel.

The friction means further may comprise one or more teeth or serrations on the second end, formed to fictionally engage the wheel upon reverse rotation thereof, while allowing forward rotation thereof.

An adjusting means may be provided for adjustably positioning the teeth relative to the wheel. The adjusting means may comprise a slot formed in the wheel support means between the boot and the rotatable wheel support; a coupling means on the restraining member for slidably coupling the restraining member within the slot; and, a fastening means for fastening the coupling means at a selected position relative to the slot.

DETAILED DESCRIPTION OF THE PREFERRED EMBODIMENT

Figure 1:
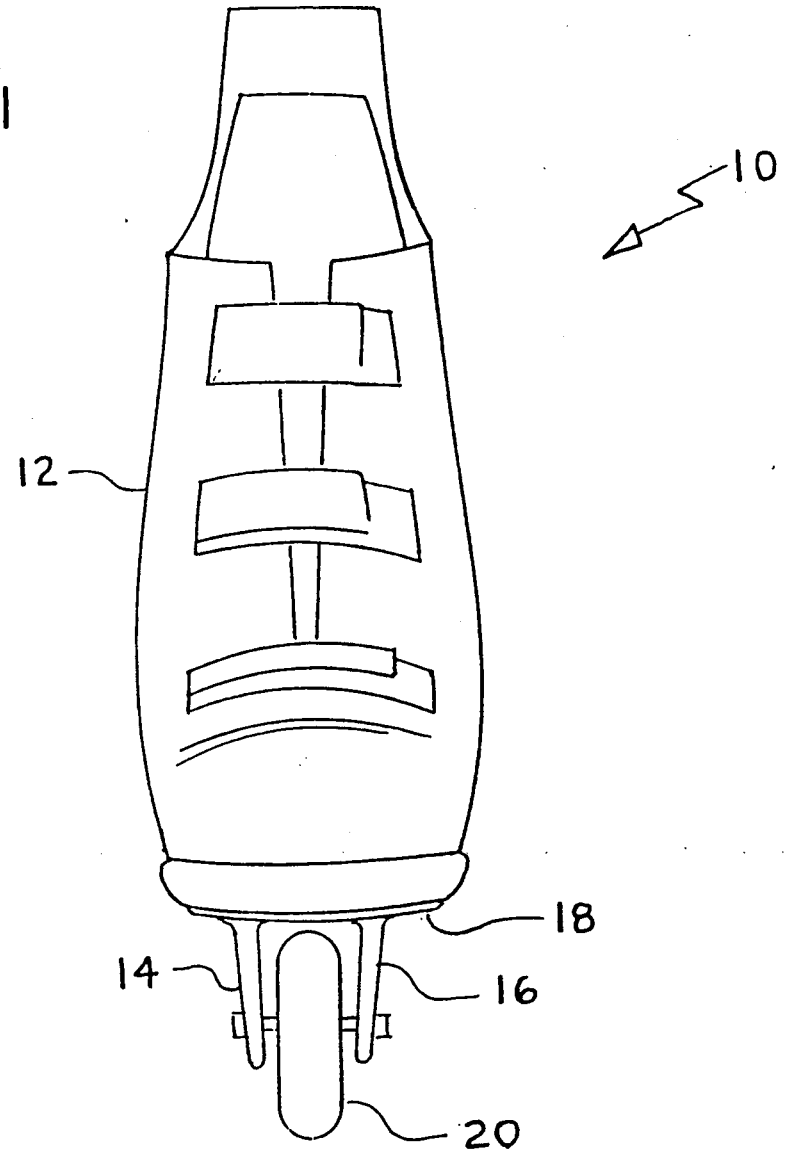
FIG. 1 PRIOR ART
FIG. 1 is a front elevation view of a prior art roller skate.

FIG. 1 depicts a typical prior art roller skate 10 having a boot 12. A wheel support means comprising first and second parallel steel members 14, 16 depends downwardly from plate 18, which is fastened to the sole of boot 12. A plurality of wheels 20 are longitudinally aligned between and rotatably supported by integral side frame members 14, 16.

Figure 2:
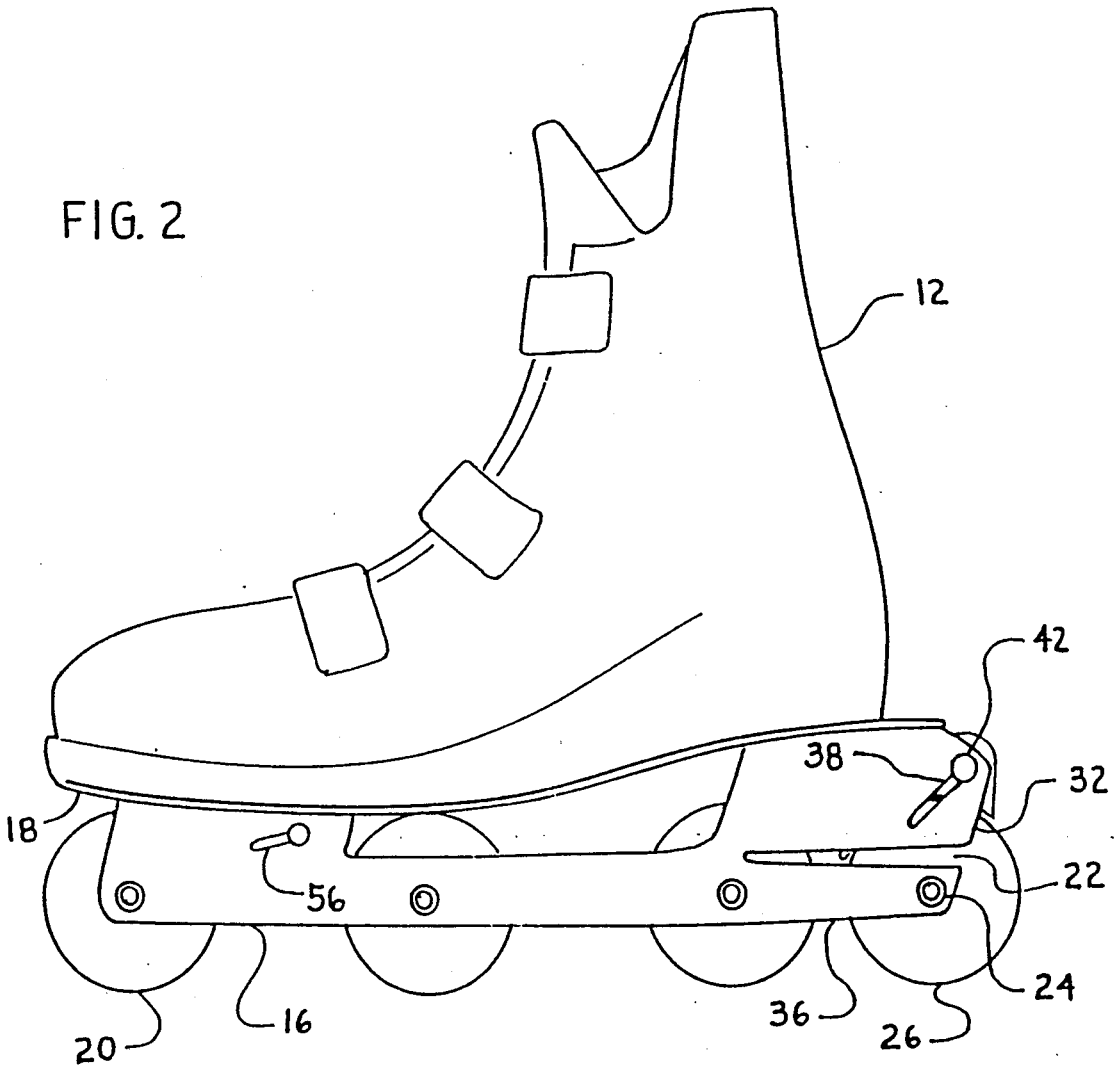
FIG. 2 is a side elevation view of a roller skate having starting and stopping aids constructed in accordance with the preferred embodiment of the invention.
Figure 5:
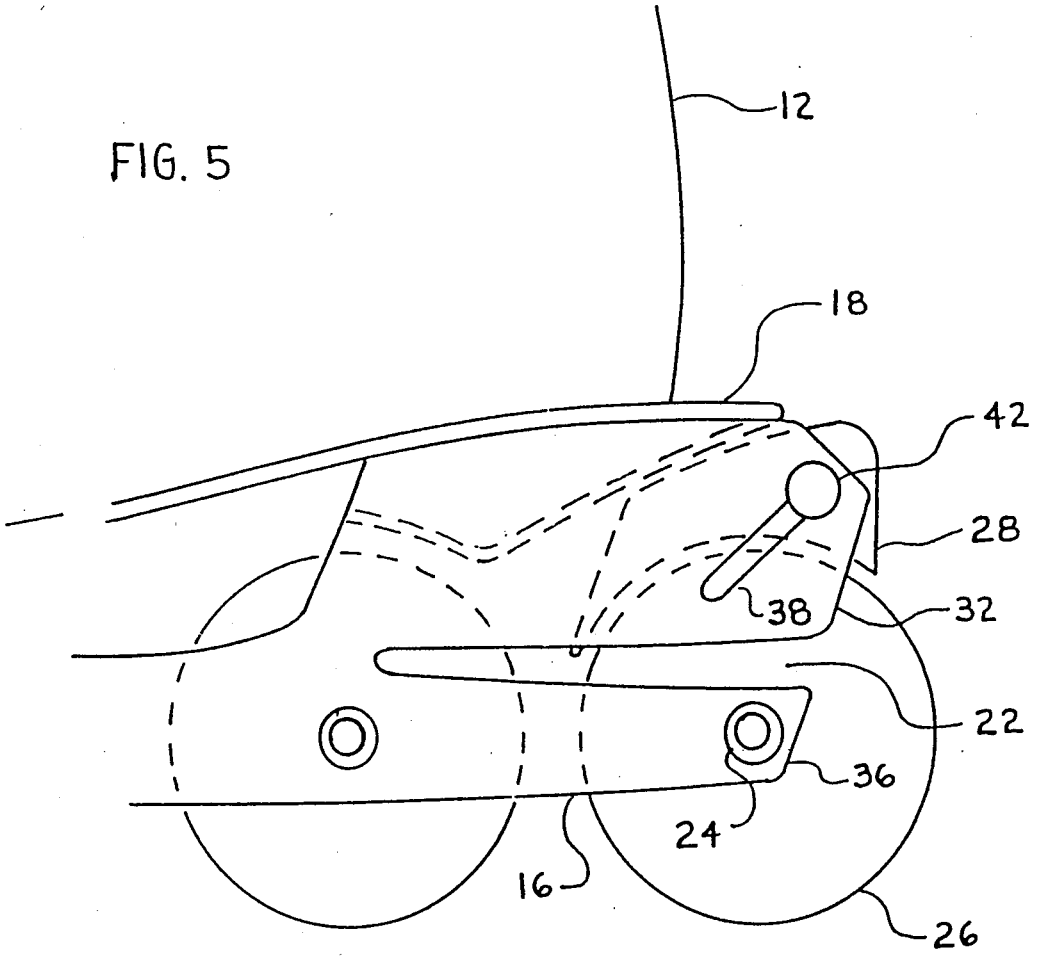
FIG. 5 is an enlarged side elevation view of the heel portion of the roller skate depicted in FIG. 2.

As depicted in FIGS. 2 and 5, the invention provides a roller skate brake which incorporates a "flex means", namely first slot 22 formed in each of members 14, 16 between boot 12 and coupling 24 which rotatably couples rear wheel 26 between members 14, 16. First slot 22 is open at the rear ends of members 14, 16. This allows slot 22 to flexibly accommodate compression of members 14, 16 adjacent rear wheel 26 when the roller skater applies a downward force to the heel region of boot 12. The length and width of slot 22 may be varied, depending upon the flexibility characteristics of the material from which members 14, 16 are made, so as to yield the desired amount of flexible compression of members 14, 16.

Figure 3:
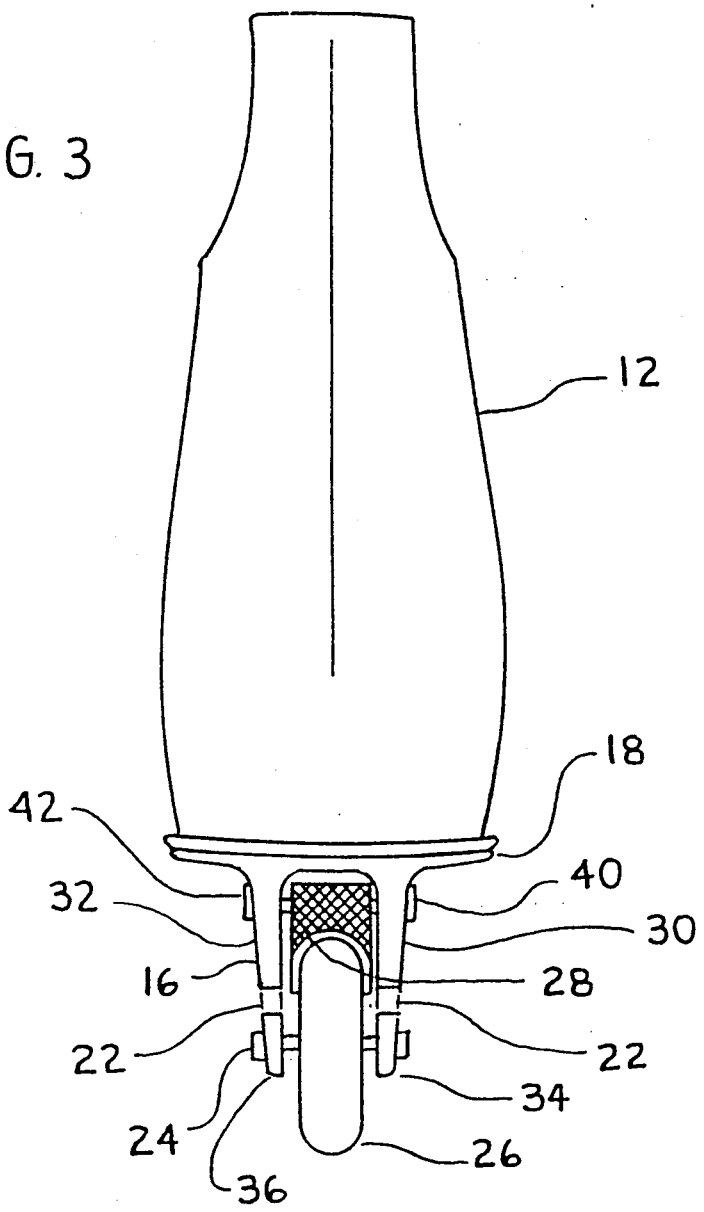
FIG. 3 is a rear elevation view of the roller skate of FIG. 2.

A brake pad 28 (FIGS. 3 and 5) is coupled between members 14, 16 in the region between the heel of boot 12 and the upper surface of rear wheel 26. When the roller skater presses down on his or her heel, the aforesaid downward force causes the lower portions 34, 36 of members 14, 16 to flex upwardly relative to upper portions 30, 32. Such flexing compresses the rear portions of members 14, 16 in proportion to the applied force, bringing brake pad 28 into contact with rear wheel 26, thereby fictionally braking the motion of rear wheel 26. The skater is accordingly able to apply a variable, controlled braking force to rear wheel 26 by shifting his or her weight to the heel region of the roller skate to which braking force is to be applied. In particular, the skater need only bear down upon the heel of the skate which is to be braked. Once sufficient braking force has been applied to slow the skater's speed to the desired rate, the skater simply stops bearing down, thereby relieving the compression aforesaid and allowing portions 34, 36 to flex downwardly, back into their original positions.

Because frictional forces will cause brake pad 28 to wear over time, an adjusting means is preferably provided for adjustably positioning brake pad 28 relative to rear wheel 26. The adjusting means may take the form of a second slot 38 (FIG. 2) provided in each of upper portions 30, 32 between boot 12 and first slot 22. A "coupling means", namely pins 40, 42 is provided on either side of brake pad 28. Pins 40, 42 protrude outwardly through the opposed sides of second slot 38 and are freely slidable along second slot 38. A suitable fastening means, such as a pair of lock nuts (not shown) may be provided on the ends of pins 40, 42. The lock nuts or other fastening means are loosened to allow pins 40, 42 to slide along second slot 38, thereby moving brake pad 28 in relation to rear wheel 26. Once brake pad 28 has been positioned in a desired location relative to rear wheel 26, the lock nuts are tightened to hold brake pad 28 in that position.

Figure 6:
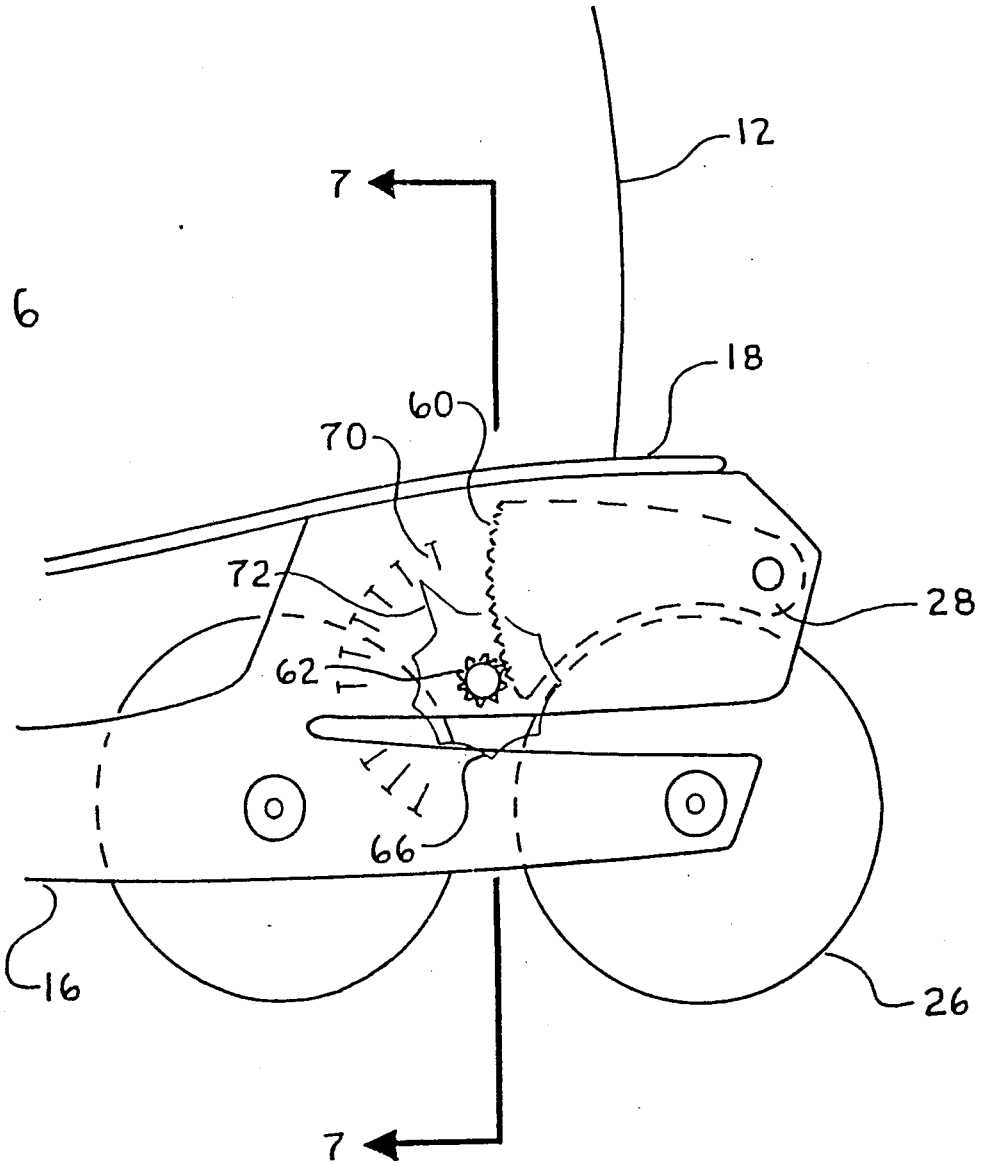
FIG. 6 is an enlarged side elevation view of the heel portion of a roller skate having an alternative mechanism for adjustably positioning a brake pad relative to a rear wheel of the roller skate.
Figure 7:
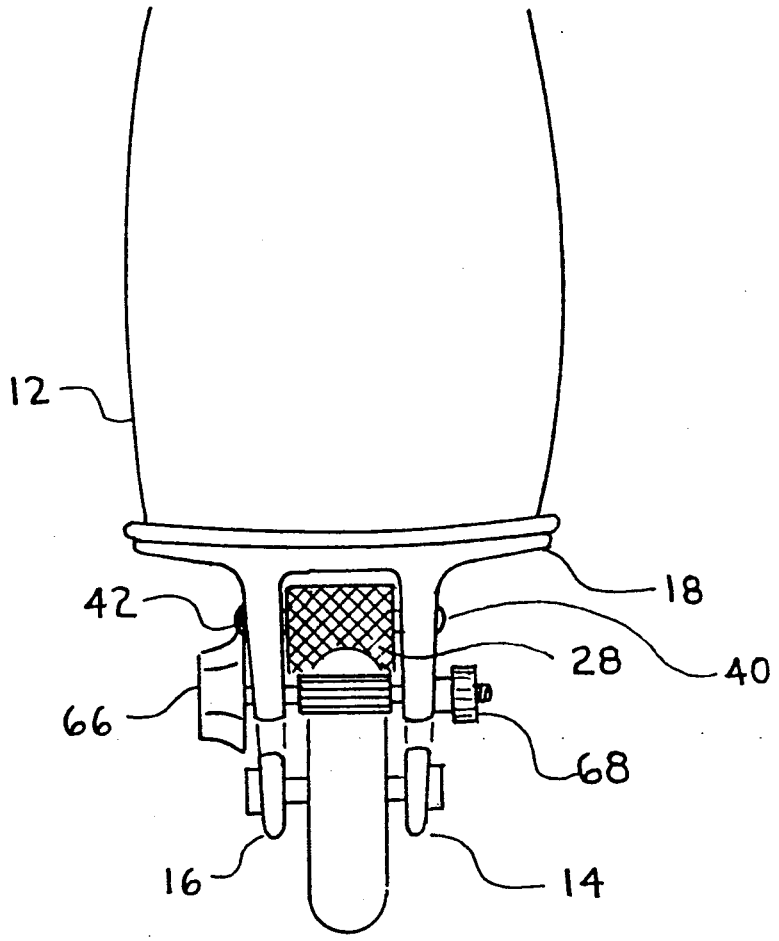
FIG. 7 is a cross-sectional view of the roller skate of FIG. 6, taken with respect to line 7—7 of FIG. 6.
Figure 8:
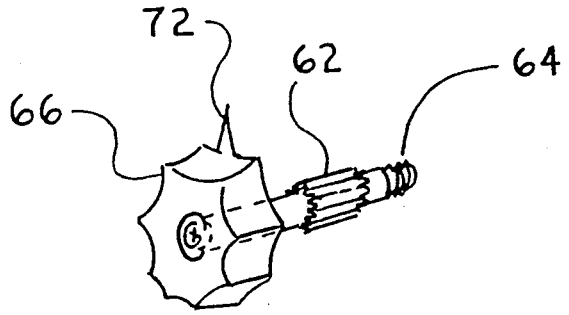
FIG. 8 is a perspective illustration of a portion of the alternative adjusting mechanism depicted in FIGS. 6 and 7.

FIGS. 6, 7 and 8 depict an alternative adjusting means for adjustably positioning brake pad 28 relative to rear wheel 26. In this case, pins 40, 42 pivotally couple the rear end of brake pad 28 to members 14, 16. A "first gear means", namely rack type gearing 60 is provided on the forward end of brake pad 28. A "second gear means", namely pinion gear 62 fixed to a shaft 64 is rotatably supported between members 14, 16 such that pinion 62 meshes with geared rack 60. An adjusting knob 66 is fixed over the end of shaft 64 which protrudes through member 16; and, a lock nut 68 is fixed over the opposite end of shaft 64 which protrudes through member 14. Lock nut 68 is loosened to facilitate rotation of knob 66. Such rotation moves the geared end of brake pad 68 upwardly or downwardly, depending upon the direction of rotation. The skater can thus easily adjust the position of brake pad 28 relative to rear wheel 26 and then tighten lock nut 68 to fix that position. If desired, a scale 70 may be provided on member 16 and a pointer 72 may be provided on knob 66 to provide a visual indication of the position of brake pad 28 relative to rear wheel 26.

Figure 4:
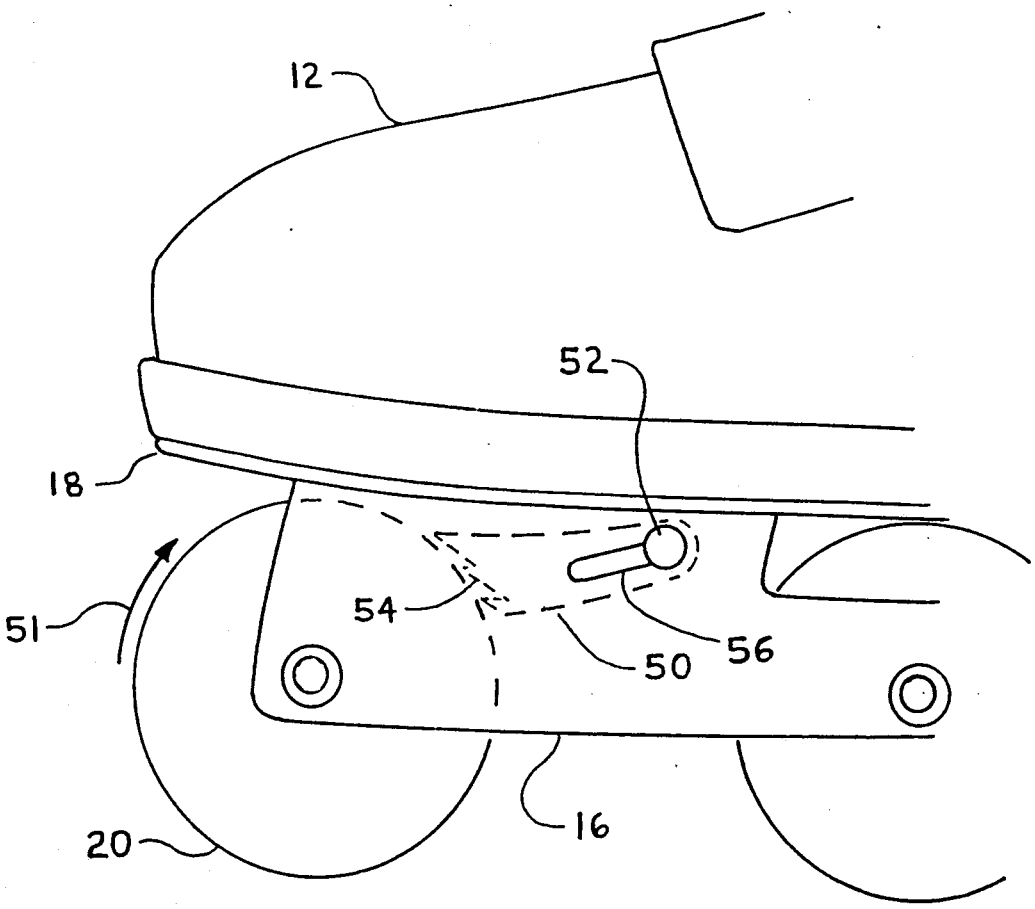
FIG. 4 is an enlarged side elevation view of the toe portion of the roller skate depicted in FIG. 2.

As depicted in FIGS. 2 and 4, the preferred roller skate starter incorporates a "restraining means", namely restraining member 50 which prevents reverse rotation of front wheel 20 (i.e. prevents rotation in the direction of arrow 51 shown in FIG. 4) while allowing forward rotation of that wheel (i.e. while allowing rotation in the direction opposite to arrow 51). One end 52 of restraining member 50 is pivotally coupled between wheel support members 14, 16 in the region above and behind front wheel 20. The pivotal positioning of member 50 is such that the second end 54 of member 50 bears against front wheel 20.

Second end 54 is equipped with friction means such as teeth or serrations which fictionally engage front wheel 20 upon reverse rotation thereof, but which allow free forward rotation of front wheel 20. More particularly, when the roller skater wishes to begin roller skating, he or she need only draw one foot backwards while holding that foot such that front wheel 20 remains in contact with the ground. This action will tend to rotate front wheel 20 in a reverse direction. However, reverse rotation of front wheel 20 is prevented by the teeth or serrations on member 50, which bite into the surface of front wheel 20. This holds front wheel 20 in a fixed position, allowing the skater to push off on that foot and begin roller skating.

Because repeated frictional engagement between the teeth of member 50 and front wheel 20 will eventually cause wearing of those parts, an adjusting means is preferably provided for adjustably positioning the teeth or serrations on member 50 relative to front wheel 20. The adjusting means may take the form of a third slot 56 (FIG. 2) provided through members 14, 16 in the region above and behind front wheel 20. A coupling means such as a pair of protruding pins may be provided on either side of member 50. The pins protrude through and slide freely along the opposite sides of slot 56. Suitable fastening means such as a pair of lock nuts may be provided over the protruding ends of each pin. The lock nuts are loosened to allow free sliding motion of the pins along slot 56, and then tightened to fasten the pins (and thus member 50) in a desired position, thereby fixing the teeth or serrations on member 50 relative to front wheel 20.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A roller skate comprising:

(a) a boot;

(b) a plurality of wheels;

(c) wheel support means adapted to be rigidly secured to said boot, said wheel support means including first and second parallel spaced integral side frame members disposed on opposite sides of said wheels, each of said members having a first slot extending forwardly from a rearmost end of said member to define upper and lower spaced portions with free ends, said upper portion being rigidly secured to said boot and said lower portion rotatably supporting a rearmost wheel of said plurality of wheels, said upper and lower portions being an integral part of said member, said lower portion being capable of flexure to move towards said upper portion upon application of a downward force on said upper portion by said boot; and, (d) a brake pad coupled between said upper portions and located between said boot and said rearmost wheel, wherein said brake pad is adapted to engage said rearmost wheel upon application of said downward force on said upper portion by said boot for applying a braking force to said rearmost wheel.

2. A roller skate as defined in claim 1, said lower portion flexure being variable in proportion to said downward force, thereby varying said braking force in proportion to said downward force.

3. A roller skate as defined in claim 1, further comprising adjusting means for adjustably positioning said brake pad relative to said rearmost wheel.

4. A roller skate as defined in claim 3, wherein said adjusting means further comprises:

(a) a second slot formed in said first and second side frame members between said boot and said first slot;

(b) coupling means on said brake pad for slidably coupling said brake pad within said second slot; and, (c) fastening means for fastening said coupling means at a selected position relative to said second slot.

* * * * *